US005787944A

United States Patent [19]

Sarkis et al.

[11] Patent Number: 5,787,944

[45] Date of Patent: Aug. 4, 1998

[54] SELF VENTING FUNNEL

[75] Inventors: Peter T. Sarkis, 17 Connell Dr., Salem, N.H. 03079; Dennis M. Daigle, Haverhill, Mass.

[73] Assignee: Peter T. Sarkis, Salem, N.H.

[21] Appl. No.: 678,223

[22] Filed: Jul. 11, 1996

[51] Int. Cl.[6] ..... B65B 11/04

[52] U.S. Cl. ..... 141/300; 141/331; 141/339

[58] Field of Search ..... 141/299, 300, 141/297, 298, 331–345

[56] References Cited

U.S. PATENT DOCUMENTS

| | | | |
|---|---|---|---|
| 57,347 | 8/1866 | Lochman | 141/300 |
| 79,799 | 7/1868 | Beaumont | 141/299 |
| 140,350 | 7/1873 | Crowther | 141/299 |
| 313,049 | 3/1885 | Bolus et al. | 141/299 |
| 334,564 | 1/1886 | Catlin . | |
| 1,498,900 | 6/1924 | Barnett . | |
| 1,705,312 | 3/1929 | Rovano . | |
| 1,810,822 | 6/1931 | Erickson . | |
| 2,584,216 | 2/1952 | Morrison . | |
| 2,811,181 | 10/1957 | Correll . | |
| 3,177,907 | 4/1965 | Baldi . | |
| 3,938,563 | 2/1976 | Gall . | |
| 4,202,386 | 5/1980 | Orr . | |
| 4,494,585 | 1/1985 | Waldecker . | |
| 4,789,017 | 12/1988 | Panasewicz et al. . | |
| 5,219,006 | 6/1993 | Bishop . | |
| 5,277,234 | 1/1994 | Warstler . | |
| 5,322,097 | 6/1994 | Wright . | |
| 5,472,025 | 12/1995 | Conrad et al. . | |
| 5,511,595 | 4/1996 | Stidham . | |

FOREIGN PATENT DOCUMENTS

| | | | |
|---|---|---|---|
| 60490 | 6/1912 | Switzerland | 141/299 |
| 25827 | 11/1906 | United Kingdom | 141/297 |

OTHER PUBLICATIONS

"New Products" *New Pig* Literature, May, 1996, p. N7.

*Primary Examiner*—Henry J. Recla
*Assistant Examiner*—Steven O. Douglas
*Attorney, Agent, or Firm*—William J. Daley

[57] ABSTRACT

A self venting funnel including a hollow member having inner and outer walls, two ends and a through passage defined by the inner wall and extending between the ends. The inner and outer walls are spaced from each other and define a region therebetween that includes a plurality of vent passages that extend between the two ends and which form a plurality of apertures in each end. The self-venting funnel further includes a chamber that extends outward from the outer wall and an overflow port or passage that extends through the region and between the inner and outer walls. If, and when, the level of material accumulating in the through passage rises so it is at or above the overflow port, the material flows into the chamber. The chamber also may include an outlet connection to automatically drain material from the chamber. A screen may be disposed within the hollow member through passage to filter the material passing through the funnel of the instant invention. The funnel may further include a shield member at one end of the funnel to direct any material flowing through any of the vent passages back into the through passage of the hollow member.

23 Claims, 4 Drawing Sheets

SELF VENTING FUNNEL

FIELD OF INVENTION

This invention relates to funnels and more particularly to self-venting funnels that automatically vent the air from a system or container while a fluid or solid material is being introduced therein.

BACKGROUND OF THE INVENTION

Closed or sealed fluid systems, such as the cooling system of a motor vehicle, include a fill port or nozzle through which fluids are introduced or added. Similarly, containers, such as bottles include a opening through which the fluid or solid material is introduced to fill the container. It is common practice to use a funnel, inserted into the container opening or system port/nozzle, to fill or add the material (e.g., liquids, fluidic solids) to these containers or sealed systems. This is done to minimize spillage and waste of the material being added. Spillage of some materials, such as the coolant for motor vehicles (e.g., anti-freeze), can create clean up and disposal problems.

When material is being added to a system or container, the air in the container or system is vented therefrom. For most prior art funnels, venting is accomplished in one of two ways. In one case, the venting is accomplished primarily through the fill hole in the funnel. That is, the funnel's fill hole is used to add material to the container/system as well as to vent the air therefrom. Depending upon the sealing ability of the funnel to the opening/nozzle, some venting also may occur in the space between the funnel and the inside surface of the opening, port or nozzle. Alternatively, the funnel is held so it does not contact the nozzle or opening while adding the material. This leaves a space between the funnel and the inside surface of the opening, port or nozzle in which the funnel is inserted. The air from the container/system vents through this space.

These techniques have a number of limitations as well as making the fill operation cumbersome and subject to unwanted spillage. For example, when venting through the funnel fill hole, the air is vented discontinuously or unevenly and the flow of materials through the funnel fluctuate and even may slow to almost a stop. This is particularly noticeable when adding high viscosity fluids (e.g., gear oil, motor oil additives). Also, when using the fill hole as the vent path the air commonly bubbles through the material being added. This creates the potential for unwanted spillage as well as splashing of the one holding the funnel and/or adding the material. Further, for either technique over filling the system/container results in spillage and the fill operation can involve two people to minimize risk of spillage.

One method for venting or purging a motor vehicle cooling system, involves locating a large fluid filled funnel in the neck of the radiator while the engine is running. As the engine runs and heats up, the air trapped in the cooling system works its way into the radiator. The air in the radiator escapes out through the fill hole in the funnel and the volume occupied by the air in the radiator is replaced by fluid from the funnel. This process, however, is subject to spillage because of the venting through the fill hole and because of the pressure surges seen during normal system operation. Also, it is necessary for the mechanic to keep checking the funnel fluid level which limits a mechanic's ability to work on other cars. Because cooling systems use anti-freeze all year round, the spillage of fluid from the funnel can make clean-up costly as well as time consuming.

There are some prior art funnels that include a mechanism for self venting, such as those described in U.S. Pat. Nos. 5,277,234; 4,494,585; 4,202,389; 1,705,312; and No. 334,564. Notwithstanding the inclusion of a self venting mechanism these funnels are cumbersome, are subject to unwanted spillage and/or are complex.

The funnel described in U.S. Pat. No. 5,277,234 includes a plurality of open, spaced, parallel, channel-like depressions formed in the outside surface of the funnel. These depressions are arranged so the air is vented from the container up along the outside surface of the funnel. This funnel is provided with a flapper valve arrangement in the guide conduit portion to prevent overfilling of the container. However, because the depressions are in the outside surface, there is no other means for preventing unwanted spillage of material from an overflowing container (i.e. backflow of material). That is, one cannot establish a leak tight connection between funnel and the container/closed system being filled.

The funnel described in U.S. Pat. No. 4,494,585 includes a vent/siphon subassembly. The vent/siphon subassembly, includes a large venting passage that communicates with the interior of the container being filled and an angled pipe section. The angled pipe section is interconnected to a flexible conduit that runs exterior to the funnel. The conduit also is routed back to the open mouth of the funnel so it discharges downwardly into the funnel's mouth and beneath a baffle. Thus, the air being vented as well as any fluid passes through the angled pipe section, into the flexible conduit and is discharged from the flexible conduit back into the funnel's mouth. Such a funnel is bulky and cumber-some to use. Also, the flow area available for venting is limited by the size of the conduit and the angled pipe section.

As with the foregoing described funnels, there is the potential for unwanted spillage, splashing or discharges of material directly to the environment for the funnels described in U.S. Pat. Nos. 4,202,389, 1,705,312, and No. 334,564.

While some of the foregoing prior art funnels include some mechanism for self-venting, there is a need for a self-venting funnel that is simple in design and usage, which minimizes or avoids unwanted spillage. It also is desirous for the self-venting funnel to allow the fill operation to be performed by one person and to include overflow protection.

SUMMARY OF THE INVENTION

The self-venting funnel according to the instant invention includes a hollow member having inner and outer walls, two ends and a through passage defined by the inner wall and extending between the ends. The inner and outer walls are spaced from each other to define a region therebetween. The region therebetween includes a plurality of vent passages that extend between the two ends and which form a plurality of apertures in each end.

The hollow member may be a truncated conically shaped member. Alternatively, the hollow member may comprise an upper and lower section, each section having a different geometric cross-section. The upper and lower sections are mated to each other so as to form a single structure where the vent passages extend through the upper and lower sections to the ends of the hollow member.

The self-venting funnel may further include overflow protection to minimize spillage of material. To accomplish this, the self-venting funnel further includes a material collection chamber that extends outward from the hollow member outer surface and an overflow port or passage that extends through the region and between the inner and outer walls. In this way, the hollow member through passage is put in fluid communication with the material collection chamber. Thus, if and when the level of the material accumulating in the hollow member through passage rises so it is at or above the overflow port, the material flows into the collection chamber.

A drain passage may be provided in the hollow member, where the drain passage extends through the region and between the inner and outer walls. A valving mechanism also may be provided that selectively opens and closes the drain passage. The drain passage provides a means by which material accumulating in the collection chamber can be drained back into the funnel and used for filling a container/system.

The chamber also may include an outlet connection to drain material accumulating in the chamber (i.e., the chamber interior) and/or the interior of the funnel. A valving mechanism may be provided for selectively opening and closing the outlet connection. In this way, material can be controllably discharged to an external container thereby minimizing the potential for spillage.

A shield member is provided at the end of the funnel's hollow member whereat material is introduced. Additionally, the shield member extends about the circumference of that end of the hollow member. Further, the shield member is configured so as to direct any material flowing through any of the vent passages back into the through passage of the hollow member. In an exemplary embodiment, the shield member is substantially arcuate or curved in shape.

A screen may be disposed within the hollow member through passage to filter the material passing through the funnel of the instant invention. The screen preferably is conical in shape and is disposed in the through passage such that the vertex of the cone is closer to the end of the hollow member whereat material is introduced. The screen also is removably disposed so the funnel can be easily and readily reconfigured with a screen having a mesh size appropriate for a given application.

The vent passages extend about at least a portion of the circumference of the hollow member ends and preferably about the entire circumference. However, when the funnel is configured with an overflow port, it is preferred that vent passages do not extend about the circumference in the area of the overflow port.

Each vent passage may have a circular cross-section, however, each vent passage may have any of a number of geometrical cross-sectional shapes. Further, the hollow member may include inner and outer members that are spaced from each other by a plurality of ribs that are interconnected to, and maintain the inner and outer members in spaced relation. The ribs also extend along the length of the funnel. In this way, the ribs and the inner and outer members thus define a plurality of vent passages in the hollow member.

The self-venting funnel of the instant invention is advantageous in that it is simple in design, and in use, while maintaining the capability to automatically vent air venting from a container or system. This self-venting funnel also: maximizes flow area for venting, includes overflow protection thereby minimizing or avoiding spillage of material, and, with the use of adapters, can be used over a wide range of different sized nozzles and openings. Further, the self-venting funnel of the instant invention allows filling of a container or system by one person.

BRIEF DESCRIPTION OF THE DRAWING

For a fuller understanding of the nature and desired objects of the present invention, reference should be made to the following detailed description taken in conjunction with the accompanying drawing figures wherein like reference character denote corresponding parts throughout the several views and wherein.

DESCRIPTION OF THE PREFERRED EMBODIMENT

Figure 1:
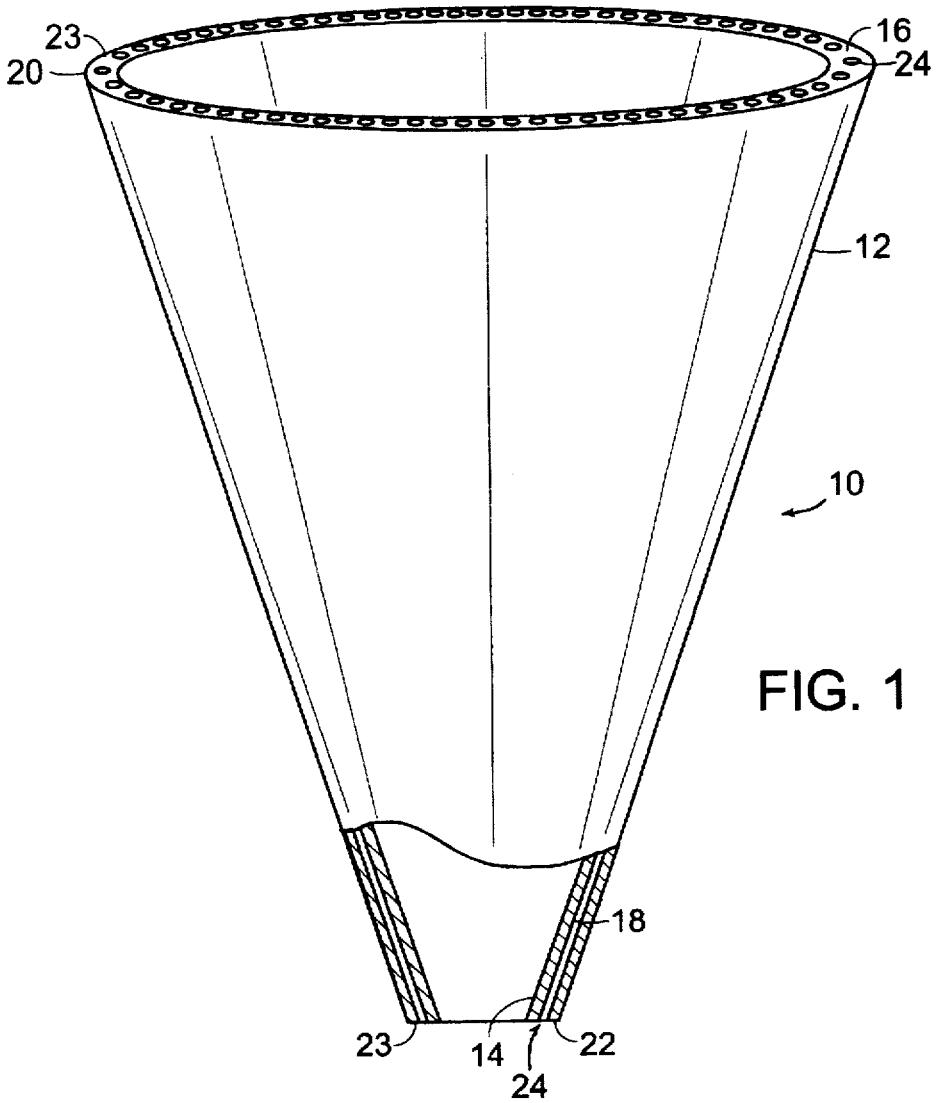
FIG. 1 is a perspective view, with a partial cross-sectional breakaway, of a self venting funnel of the present invention.

There is shown in FIG. 1, a self-venting funnel 10 according to the instant invention having an outer surface 12 and an inner surface 14. The inner and outer surfaces 12, 14 are spaced from each other so that an annular region 16 is formed therebetween. In use, material is introduced into the inlet or wide end 20 of the funnel 10 so the material flows along the inside surface 14 and out the outlet or narrow end 22 into the container or system. The materials that pass through the funnel 10 include liquids such as water, alcohol, anti-freeze, glycol, motor oil, gear oil and fluidic solids such as flour, sugar, salt. Fluidic solids shall be understood to generally encompass those solids which flow under the influence of gravity particularly at STP conditions (e.g., room temperature).

Figure 4:
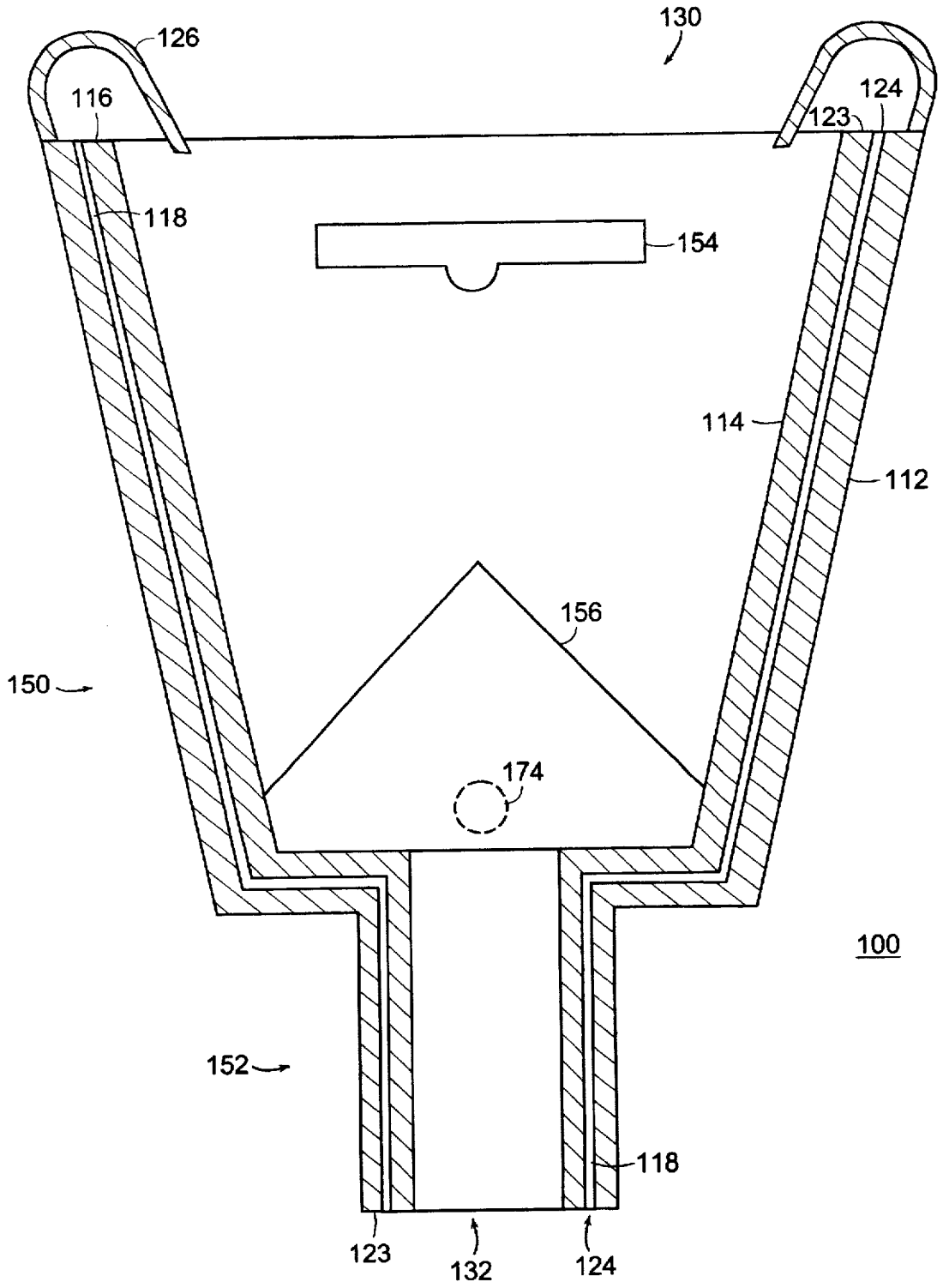
FIG. 4 is a cross sectional view of another self venting funnel according to the instant invention.

While the funnel 10 is illustrated as having a generally truncated conical shape, this is not a limitation. It is within the scope of the present invention for the funnel to have any shape or combination of shapes that can be practiced with the other objects and features of the subject invention. This includes a funnel having a conical upper section, that receives the material being added, mated to a cylindrical lower section as illustrated in FIG. 4.

In a preferred embodiment, the annular region 16 includes a plurality of passages 18 that extend along the length of the funnel 10 and between its ends 20, 22. These passages 18 also extend through the end surfaces 23 of the annular region 16 so as to define a plurality of apertures 24 therein. Thus, when the funnel's narrow end 22 is inserted into a container opening or a system's nozzle or port, the interior of the container/system is interconnected to the atmosphere via the passages 18 and apertures 24 during the process of filling or adding material.

The total number of passages 18 and apertures 24 and the cross sectional area for each are established to maximize the total flow area available for venting of air from the container/system while yielding a funnel 10 that has sufficient structurally rigidity to withstand the intended service. That is, the funnel 10 can be filled with a material such as a water without the funnel exhibiting noticeable structural buckling or bending. Also, while the passages 18 and through apertures 24 are illustrated as being circular, it is within the scope of the present invention for the passages and/or the apertures to have any geometrical shape (e.g., oval, polygonal, rectangular).

In one embodiment, a funnel having a ¾ in. outlet is configured with 23 circular through holes 18 in the region 16 between the inner and outer funnel surfaces 12,14. These through holes also are disposed about the periphery of the funnel. The region therebetween is about ⅛ in thick and the diameter of each circular through hole is about 50 mils (0.0050 in.). Fluids flow freely through such a funnel as the air vents through the circular through holes.

Figure 2B:
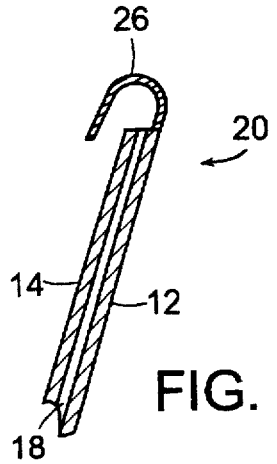
FIG. 2B is cross sectional view of the lip of the funnel of FIG. 1 further including an overflow shield.
Figure 2A:
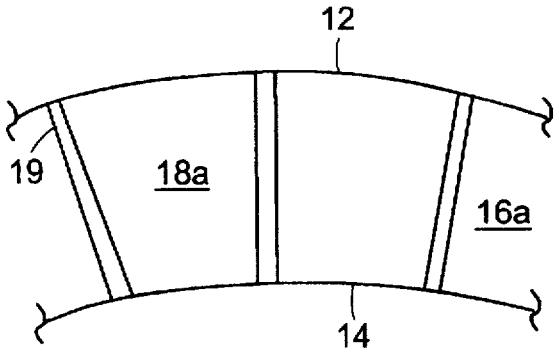
FIG. 2A is partial plan view of alternate annular region passages for the funnel of FIG. 1.

Alternatively, as illustrated in FIG. 2A, the inner and outer surfaces 12,14 may be spaced from each other by means of radially extending ribs 19 so as to form a plurality of hollow annular passages 18*a*. These annular passages 18*a*, like those of FIG. 1, extend along the length of the funnel 10 and between its ends 20, 22. The end surfaces of the annular region 16*a* include through apertures, each preferably having the cross sectional shape of the annular passages 18*a*. It is, however, within the scope of the instant invention for the through apertures and/or annular passages to have any geometrical shape other than that illustrated.

In yet another embodiment, two members comprising the inner and outer surfaces 12,14 are spaced from each other so as to form an essentially hollow annular region therebetween. The members comprising the inner and outer surfaces 12,14 are supported in any fashion known to those skilled in the art for maintaining the two members in a fixed, spaced relation (e.g., spacer rods). The ends of the annular region may remain open to the entire hollow region or, alternatively, each end may include a surface element having a plurality of apertures therein that communicate with the hollow annular region.

In a further embodiment, the self-venting funnel 10 includes an overflow shield 26, as shown in FIG. 2B, to further minimize the potential for spillage and splashing. The overflow shield 26 is disposed at the wide end 20 of the funnel and preferably extends about the entire circumference of the wide end 20. The overflow shield 26 also is preferably configured (e.g., curved) so it directs any flow of material back through a vent passage 18 onto the inner surface 14. The overflow shield 26 may be integral with the funnel 10 so as to form a unitary structure. Alternatively, the overflow shield 26 may be constructed so it snaps onto, or is otherwise affixed (e.g., glued), to the funnel at the wide end 20.

In use, the outlet or narrow end 22 of the funnel 10 is inserted into the opening or nozzle of the container/system until the outer surface 12 contacts the opening/nozzle (i.e., until funnel stops). Preferably, the funnel outer surface 12 also sealingly engages the opening/nozzle so the air does not vent along the outside surface nor can material backflow from the container up and along the outside surface. In this position, the through hole apertures 24 in the end surfaces 23 and the passages 18 establish a vent flow path between the interior of the container/system and the atmosphere.

The material (e.g., fluids, fluidic solids) to be added is then poured/introduced into the opening at the wide end 20. The material flows downward along the inner surface 14 and out the opening in the narrow end 22 into the container/system. As the material flows into the container/system, the air being forced/vented therefrom passes through the apertures 24 and the passages 18 and out to the atmosphere. That is, the air from the container/system is automatically vented to atmosphere by the self-venting funnel 10 of the instant invention. When the filling or adding operation is completed, the funnel 10 is removed from the opening/nozzle and the container or system is sealed/closed.

Figure 3A:
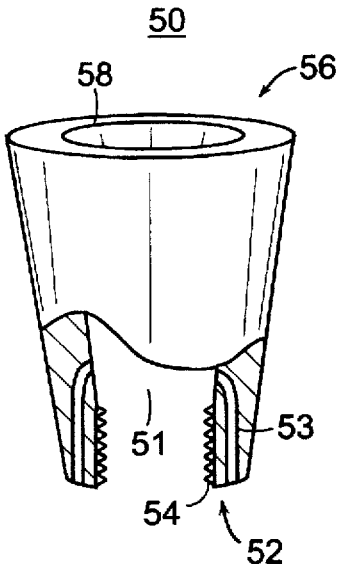
FIGS. 3A,B are adapters for the funnel of FIG. 1.

In yet another embodiment, and to increase flexibility, the funnel 10 of the instant invention is used with an adapter 50,60 (FIGS. 3A,B). In this way, the funnel 10 does not have to be sized for a given size opening. Rather, one sized funnel 10 may be used for a wide range of types or sizes of nozzle/openings by means of an appropriately sized and configured adapter 50, 60. That is, the funnel 10 is adjusted to suit a given application by selecting an adapter 50,60 that is appropriate for the intended use.

Figure 3B:
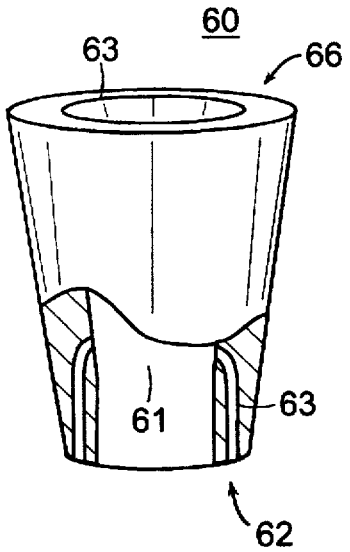

As shown in FIG. 3A, one adapter 50 is configured to be used with nozzles/openings having a screw-on/off type of connection. Accordingly, the first end 52 of the adapter 50 includes a plurality of threads 54 that threadably engage the threads of the opening or nozzle. Alternatively, as shown in FIG. 3B, the first end 62 of another type of adapter 60 is configured so the first end is insertable into the opening or nozzle.

The second end 56,66 for both adapters 50,60 includes an aperture 58,68 that opens to an interior passage 51, 61. In use, the funnel narrow end 22 is inserted into the aperture 58,68 until the narrow end is secured therein. For example, the adapter 50,60 and funnel 10 may be designed so there is an interference fit between the inner surfaces of the adapter's aperture 58, 68 and the funnel's outer surface 12.

When the funnel narrow end 22 is secured within the adapter 50,60, the funnel's venting passages 18 communicate with the interior of the container/system via the adapter's interior passages 51,61. In this way, the air venting from the container/system passes through the adapter's interior passages 51, 61 and thence through the funnel's venting passages 18. Alternatively, the adapter may be configured with a plurality of venting passages 53, 63 that bypass the adapter interior passage 51,61. Like the funnel 10 of FIG. 1, one end of each passage 53,63 in the adapter 50,60 is located along the circumference of the adapter first end 52, 62. The other end of each adapter passage 53,63 communicates with the adapter's interior passage 51,61. This provides a separate flow path for the air being vented from the container/system to atmosphere.

In use, an adapter 50,60 is secured to both the funnel 10 and the container/system opening or nozzle thereby interconnecting the funnel and the container/system. When so secured, material backflowing from the container/system cannot pass along the outside surface of the adapter 50, 60 and/or the funnel 10. The material is then introduced into the wide end 20, passes downwardly along the inside surface, passes out the opening in the funnel narrow end 22, through the adapter and into the container/system.

As described above, as material is being added, the air is automatically vented from the container/system by means of the passages 18 and through apertures 24. If a backflow occurs, any backflowing material passes through the funnel vent passages 18 and the apertures 24, as described in the foregoing, and not escape directly to the environment. When the filling or adding operation is completed, the adapter 50,60 is removed/disconnected from the opening/nozzle, the funnel is removed from the adapter, and the container or system is sealed/closed.

There is shown in FIG. 4 another self-venting funnel 100 of the instant invention that includes a filtering capability and overflow protection. The funnel 100 includes an upper section 150 generally having a truncated conical shape and a lower section 152 being generally cylindrical in shape. The upper and lower section 150,152 maybe formed as an integral structure or they may be mated to each other so as to form an integral structure. It is also within the scope of the present invention for a funnel 10 as illustrated in FIG. 1, to include the overflow protection and filtering capabilities hereinafter described.

The upper and lower sections 150,152 include an outer surface 112 and an inner surface 114 that are spaced from each other and form a region 116 therebetween. In a preferred embodiment, the region includes a plurality of passages 118 that extend along the length of the funnel between the inlet 130 and outlet 132 of the funnel 100. Each of the passages 118 also communicates with the apertures 124 that are disposed in the end surfaces 123 of the region 116 at respectively, the inlet 130 and the outlet 132. Thus, when the funnel's outlet 132 is inserted into a container opening or a system's nozzle or port, the interior of the container/system is communicates with the atmosphere via the passages 118 and apertures 124.

Figure 5:
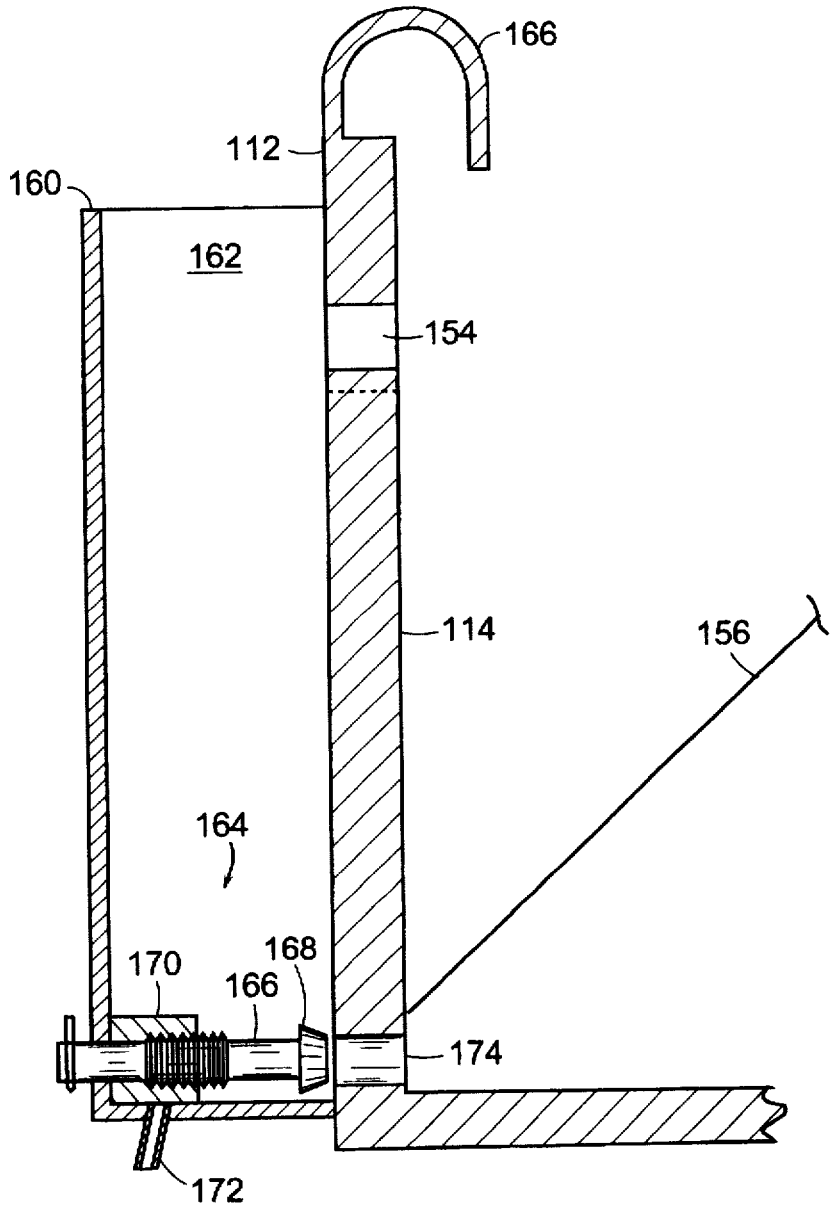
FIG. 5 is a cross sectional view of a portion of the funnel of FIG. 4 through the overflow chamber.

The passages 118 generally are arranged about the circumference of the upper and lower sections 150.152, as illustrated in FIG. 1. Preferably, however, there are no passages disposed in the upper section 150 in the area of the overflow opening 154 as illustrated in FIG. 5. The total number of the passages 118 and apertures 124 and the cross sectional area are established to maximize the total flow area available for venting of air from the container/system while yielding a funnel 100 that has sufficient structurally rigidity to withstand the intended service. Reference should be made to the foregoing discussion concerning FIGS. 1–2, for alternate arrangements and geometric shapes for the flow passages 118 and apertures 124.

In a further embodiment, the self-venting funnel 100 includes an overflow shield 126 to further minimize the potential for spillage and splashing. The overflow shield 126 is disposed at the inlet 130 of the funnel 100 and preferably extends about the entire circumference of the inlet, including the area containing the overflow opening 154. Reference should be made to the foregoing discussion for the overflow shield 26 of FIGS. 1–2 for further details regarding the overflow shield of this embodiment.

A filter screen 156 is disposed within the funnel 100 to filter the material passing through the funnel into the container/system. The filter screen 156 may be constructed from any of a number of materials known in the art for the intended use. For example, the screen material may be stainless steel when filtering liquids for automobiles such as motor oil, gear oil, anti-freeze, power steering or automatic transmission fluids of it may be a plastic material when filtering a household product such as vegetable oil.

Preferably, the screen 156 is conically shaped and the vertex of the cone is disposed above the base as illustrated in FIG. 4. In this way, gravity and the flow of material through the funnel 100 causes the contaminants that are filtered out to move downwards along the surface of the screen 156. The contaminants collect about the base of the screen 156 at the intersection of the screen and the inner surface 112. The filter screen 156 also may be removably disposed within the funnel 100 so filter screens with different mesh sizes may be used. Thus, filtering may be adjusted or selected to match the filtering requirements for a given application.

Referring also to FIG. 5 and as indicated above, the self-venting funnel 100 includes an overflow opening 154. The overflow opening 154 is arrange so it generally lies above the normal level of the material (e.g., fluid) accumulating in the upper section 150 of the funnel. If, however, the level of material flowing through the funnel rises, then any excess material passes through the overflow opening 154 into an overflow chamber 160. The overflow chamber 160 include a outlet 172 to control the discharge of material from the overflow chamber. The outlet 172 also may include a valve or valving mechanism for selectively opening and closing the outlet.

The overflow opening 154 generally is sized so the level of the material (e.g., fluid) accumulating in the funnel 100 does not rise above the lip of the funnel and thereby escape to the environment. Similarly, the overflow chamber 160 and the outlet 172 are sized so the level of any material accumulating in the overflow chamber does not rise above the overflow opening 154 and/or above the lip of the overflow chamber. Thus, excess material is discharged in a controlled fashion via the outlet 172 instead of uncontrolled spilling of the excess material on the floor, counter etc., which wastes material and requires a cleanup activity.

As noted above, when venting or purging the cooling system of a motor vehicle, a funnel filled with coolant is located in the filler neck of the radiator while the motor is running. As the motor runs and heats up, the air venting from the cooling system, as well as normal operational pressure surges in the cooling system, cause the fluid level in a funnel to rise quickly and significantly. In contrast to prior art funnels, when using the funnel 100 of the instant invention, spillage and waste of liquid is avoided because the fluid passes through the overflow opening 154 into the overflow chamber 160 when there is such a level excursion.

In a further embodiment, the overflow chamber 160 includes a valving mechanism 164 that selectively controls the flow of material out of the chamber, and back into the interior of the upper section of the funnel 100 through a port 174. Thus, material accumulating in the chamber 160 can be drained back into the funnel 100 and used in filling the container/system.

The valve mechanism 164 includes a threaded boss 170 and a rod 166 that passes through and the threadably engages the threaded boss. In use, the rod 166 is selectively moved inwardly or outwardly by turning the portion of the rod that extends outwardly of the chamber 160 in the appropriate direction. As the rod 166 moves inwardly, the flared head 168 of the rod is moved into engagement with the port 174 thereby sealing the opening when the rod 166 is moved outwardly, the flared head 168 moves away from the port 174 and any material in the chamber 160 flows or drains into the interior of the funnel 100.

The threaded boss 170 and rod 166 preferably also are arranged so the movement of the rod also control the flow of material out through the overflow chamber outlet 172. More particularly, they are selectively arrangable so the outlet 172 drains material from the interior of the funnel 100 and/or the overflow chamber 160.

In this way, when the flared head 168 is moved into engagement with the port 174, the boss 172 and rod 166 cooperate so the outlet 172 is open to drain material from the overflow chamber 160. Similarly, when the rod 166 is move outwardly a specified distance, the boss 170 and rod cooperate so the outlet 172 is open, thereby allowing any material in the chamber 160 and/or funnel to drain through the outlet 172. However, if the rod 166 is at some intermediate distance, the boss 170 and rod cooperate so the outlet 172 is closed and the port 174 is open. In this arrangement, material can drain from the chamber 160 into the funnel 100 as described above.

When using the funnel 100 of the instant invention, the outlet 132 is inserted into the opening or nozzle of the container/system such as the fill neck of the radiator. Preferably, the funnel outer surface 112 also sealingly engages the opening/nozzle so the air being vented does not vent along the funnel outside surface nor can material backflow along the funnel outside surface. When inserted, the through hole apertures 124 in the end surfaces 123 and the funnel vent passages 18 establish a vent flow path between the interior of the container/system and the atmosphere. The material (e.g., fluids, fluidic solids) to be added is then poured/introduced into the funnel inlet 130. The material flows downward, along the inner surface 114, and comes into contact with the filter screen 156. As described above, the filter screen 156 filters out contaminants and the filtered material passes out the opening in the outlet 132 into the container/system.

As the material flows into the container/system, the air being forced therefrom passes through the apertures 124 and the passages 118 to the atmosphere. That is, the air from the container/system is automatically vented to atmosphere by the self-venting funnel 100. If during the filling or addition process the level of any material accumulating in the funnel 100 raises above a set level, the material flows out an overflow opening 154. The overflowing material collects in the chamber 160 or the material flowing into the chamber passes through the outlet 172 and is collected in an external container (not shown).

When the filling or adding operation is completed, the funnel 100 is removed from the opening/nozzle and the container or system is sealed/closed. If there is any material in the overflow chamber 160 and/or within the interior of the funnel 100, then this excess material is drained from the funnel interior and/or chamber by means of the outlet 172/port 174 prior to removing the funnel as described in the foregoing.

Preferably, the funnel 10,100 and the adapters 50,60 of the instant invention are constructed from any number of materials known in the art for use in making funnels including plastics. At least a portion of the outside surface 12,112 of the funnel or the outside surface of an adapter 50,60 may also include a material coating, such as a rubber, to locally enhance the sealing ability of the funnel and/or adapter with the nozzle or opening.

While a preferred embodiment of the invention has been described using specific terms, such description is for illustrative purposes only, and it is to be understood that changes and variations may be made without departing from the spirit or scope of the following claims.

What is claimed is:

1. A self-venting funnel comprising:

a hollow member having an inner wall, an outer wall, two ends and a through passage extending between the ends;

wherein the inner wall is spaced from the outer wall so as to form a region therebetween;

wherein the region includes a plurality of vent passages that extend between the ends of the hollow member and form a plurality of apertures in each end;

a chamber extending outwardly from the hollow member outer wall;

an overflow port extending through the region and between the inner and outer walls so the through passage and the chamber are in fluid communication with each other; and wherein material flows through the overflow port into the chamber when the level of material accumulating within the through passage rises so it is at or above the overflow port.

2. The self-venting funnel of claim 1, wherein the vent passages are circular in cross section.

3. The self-venting funnel of claim 1, wherein the hollow member comprises an inner member, an outer member and a plurality of ribs affixed to the inner and outer members so as to maintain the inner and outer members in spaced relation from each other, wherein the ribs and inner and outer members are arranged such that they define a plurality of vent passages extending between the ends.

4. The self-venting funnel of claim 3, further comprising a shield member extending about the circumference of one end of the hollow member, the shield member being configured so as to direct any material flowing through any of the vent passages back into the through passage of the hollow member.

5. The self-venting funnel of claim 1, further comprising a shield member extending about the circumference of one end of the hollow member, the shield member being configured so as to direct any material flowing through any of the vent passages back into the through passage of the hollow member.

6. The self-venting funnel of claim 1, further comprising a screen disposed within the through passage of the hollow member.

7. The self-venting funnel of claim 6, wherein the screen is conically shaped and the vertex of the cone is arranged so it is closer to the end where material is introduced.

8. The self-venting funnel of claim 7, wherein the screen is removably disposed in the through passage.

9. The self-venting funnel of claim 1, wherein the chamber further includes an outlet that drains material from the interior of the chamber.

10. The self-venting funnel of claim 9, wherein the chamber further includes a valving mechanism that selectively opens and closes the outlet.

11. The self-venting funnel of claim 1, further comprising a drain passage extending through the region and between the inner and outer walls and a valving mechanism that selectively opens and close the drain passage, wherein the chamber and hollow member through passage are in fluid communication when the drain passage is open.

12. The self-venting funnel of claim 11, wherein the chamber further includes an outlet so that material can be selectively drained from at least one of the chamber and the hollow member through passage.

13. The self-venting funnel of claim 1, wherein the plurality of passages extend about at least a portion of the circumference of the hollow member ends.

14. The self-venting funnel of claim 13, wherein the plurality of passages extend about the circumference of the hollow member ends.

15. The self-venting funnel of claim 1, further comprising an adapter having two ends and an interior passage, wherein one end of the hollow member is inserted into the adapter interior passage and secured therein.

16. The self-venting funnel of claim 1, wherein the hollow member is a truncated conically shaped member.

17. The self-venting funnel of claim 1, wherein the hollow member comprises an upper and lower section, wherein the upper and lower sections have different geometric cross sections, and wherein the upper and lower sections are mated to each other so the vent passages extend between the hollow member ends.

18. A self-venting funnel comprising:

a truncated conical member having an inner wall, an outer wall, two ends, a through passage extending between the ends and a long axis;

wherein the inner wall is spaced from the outer wall so as to form an annular region therebetween about the long axis;

wherein said annular region includes end surfaces at each end of said conical member;

a plurality of vent passages disposed in the annular region and forming apertures in the end surfaces of the annular region;

a chamber extending outwardly from the hollow member outer wall;

an overflow port extending through the region and between the inner and outer walls so the through passage and the chamber are in fluid communication with each other; and wherein material flows through the overflow port into the chamber when the level of material accumulating within the through passage rises so it is at or above the overflow port.

19. The self-venting funnel of claim 18, further comprising a shield member extending about the circumference of one end of the hollow member, the shield member being configured so as to direct any material flowing through any of the vent passages back into the through passage of the hollow member.

20. The self-venting funnel of claim 18, further comprising a screen disposed within the through passage of the hollow member.

21. The self-venting funnel of claim 20, wherein the screen is conically shaped and the vertex of the cone is arranged so it is closer to the end where material is introduced.

22. The self-venting funnel of claim 18, wherein the chamber further includes an outlet that drains material from the interior of the chamber.

23. The self-venting funnel of claim 18, further comprising a drain passage extending through the region and between the inner and outer walls and a valving mechanism that selectively opens and close the drain passage, wherein the chamber and hollow member through passage are in fluid communication when the drain passage is open.

* * * * *